United States Patent [19]

Mager et al.

[11] 4,251,569

[45] Feb. 17, 1981

[54] METHOD OF COATING ARC DISCHARGE LAMP ELECTRODE

[75] Inventors: Eric L. Mager, Beverly; Willy P. Schreurs, Danvers, both of Mass.

[73] Assignee: GTE Products Corporation, Stamford, Conn.

[21] Appl. No.: 624,627

[22] Filed: Oct. 22, 1975

[51] Int. Cl.[3] ..... H01J 9/02; H01J 1/14; H05B 31/00; H05B 31/14

[52] U.S. Cl. ..... 427/58; 106/123 R; 106/123 LC; 252/521; 427/67; 427/111; 427/116; 427/117; 427/120; 427/77; 313/345; 313/346 R

[58] Field of Search ..... 427/111, 116, 117, 120, 427/77, 78, 67; 313/345, 346 R, 326, 341, 344, 357; 252/521; 428/371, 378, 379, 389, 357, 364, 369, 375, 377; 106/123 R, 123 LC, 308 S, 306, 308 R, 308 Q, 63, 1, 38.2, 38.22, 38.23, 81, 83, 87, 236, 237, 239; 260/17.5, 124; 29/25.1, 25.11, 25.17

[56] References Cited

U.S. PATENT DOCUMENTS

| | | | |
|---|---|---|---|
| 2,007,923 | 7/1935 | Braselton | 313/357 X |
| 2,443,889 | 6/1948 | Bruce et al. | 260/17.5 |
| 2,457,357 | 12/1948 | Fenn | 106/123 LC X |
| 2,552,654 | 5/1951 | Swanson | 252/521 |
| 2,560,953 | 7/1951 | Homer | 313/212 |
| 2,579,482 | 12/1951 | Fenn | 106/123 LC X |
| 2,580,708 | 12/1952 | Wallace | 106/123 R X |
| 2,622,992 | 12/1952 | Bergue | 106/123 R X |
| 2,673,387 | 3/1954 | Forker | 252/521 |
| 2,724,070 | 11/1955 | Heine et al. | 428/389 X |
| 2,760,943 | 8/1956 | Sohn | 106/123 R X |
| 2,800,446 | 7/1957 | Fredenburgh | 427/111 |
| 2,822,358 | 2/1958 | Hearon et al. | 260/124 |
| 2,839,415 | 6/1958 | Gmeiner | 106/123 R X |
| 2,872,329 | 2/1959 | Scripture, Jr. et al. | 106/92 |
| 2,895,854 | 7/1959 | La Rocque | 428/389 X |
| 2,933,405 | 4/1960 | Witt et al. | 106/123 R |
| 2,954,353 | 9/1960 | Bruce et al. | 260/17.5 |
| 2,986,671 | 5/1961 | Kerstetter | 313/345 |
| 3,216,839 | 11/1965 | Webster | 106/123 R |
| 3,293,054 | 12/1966 | Lennox et al. | 106/123 R |
| 3,520,709 | 7/1970 | Mogg et al. | 106/123 R X |
| 3,632,362 | 1/1972 | Urushiyama et al. | 106/123 LC |
| 3,766,423 | 10/1973 | Menelly | 313/341 X |
| 3,894,878 | 7/1975 | Mansmann | 106/123 R X |
| 3,923,532 | 12/1975 | Morman | 106/63 X |

FOREIGN PATENT DOCUMENTS

| | | | |
|---|---|---|---|
| 801190 | 12/1968 | Canada | 313/345 |
| 1205090 | 9/1970 | United Kingdom | 427/108 |

*Primary Examiner*—Michael F. Esposito
*Attorney, Agent, or Firm*—James Theodosopoulos

[57] ABSTRACT

An arc discharge lamp electrode is coated by applying thereto a suspension of alkaline earth compounds in a liquid vehicle of lignosulfonic acid, ammonia and ethylene glycol.

2 Claims, No Drawings

METHOD OF COATING ARC DISCHARGE LAMP ELECTRODE

THE INVENTION

In hot cathode type electronic devices, such as thermionic tubes and discharge lamps, an alkaline earth compound or a mixture of alkaline earth compounds is usually coated on a metallic substrate. One common substrate is a coiled coil of tungsten wire an example of which is shown in U.S. Pat. No. 2,560,953.

Generally, in the application to the substrate of a coating of the alkaline earth compounds (customarily selected to be thermally decomposable to the corresponding oxides) a liquid vehicle is employed as a carrier. This liquid vehicle generally contains as its major component a volatile spirit solvent, and as its minor component a solid but heat-fugitive material, which is dissolved in the solvent. After application of the coating, the vehicle dries and its residue serves as a temporary binder for the coating.

As is known, the finely powdered alkaline earth compounds are physically suspended in the liquid vehicle. The suspending process is often assisted by the employment of a suitable period of ball milling or pebble milling. The final suspension thus produced is frequently referred to as a cathode coating or cathode suspension and is applied, for example, by dipping, spraying or brushing.

In previous practice, the liquid vehicle mentioned above has customarily been a solution of a cellulosic dervative, e.g., nitrocellulose, dissolved in a common or conventionally well-known spirit type solvent, such as butyl acetate. This system works well when only a moderate loading of the vehicle with alkaline earth compounds (usually the carbonates) is required in order to achieve the desired coating weight on the substrate.

A fairly typical loading, which would fall within the customarily acceptable range, is about 1.75 grams of alkaline earth compounds per milliliter of liquid vehicle. Loading is an especially important parameter of the total cathode coating suspension because the maximum achievable coating weight of active material (or, more properly, material to be activated), which can be successfully applied to the substrate from any specific suspension is usually primarily dependent upon the loading, taken in conjunction with the flowing and wetting properties characteristic of that particular suspension. The coating weight obtained is only secondarily dependent, and to a considerably lesser degree, on the coating method and technique employed.

If considerably higher-than-normal coating weights become desirable (as, for instance, to lengthen the operating lifetime of the device being manufactured), then higher-than-normal loadings are necessary. In the conventional type of coating suspension system, the task of increasing the loading to any substantially higher level is not feasible. This is due to the development of a paste-like consistency in the suspension. Often, too, a region of loading values is found wherein the consistency of the suspension is thixotropic. This region, when it exists, lies between the ordinarily practical range of loadings within which the mixture retains a usable degree of fluidity, and the eventually reached region of paste-like consistency. The development of thixotropy is enhanced by extra milling, which is necessitated by any attempt to reach higher-than-normal loading.

Our invention overcomes the above-enumerated disadvantages and problems ordinarily associated with highly loaded suspensions of cathode coating materials. We have attained high loadings in suspensions of good fluidity and no thixotropy. Our invention uses a liquid vehicle which comprises a water solution of multi-purified lignosulfonic acid neutralized with an excess of ammonia and admixed with a substantial amount of ethylene glycol or similar liquid hydroxy compound. Small quantities of additives, such as dispersing or anti-foaming agents, may also be included.

A specific example of a liquid vehicle used in accordance with this invention is as follows:

Lignosulfonic acid (9.6% solution in water): 55% by volume

Aqua ammonia (C.P. concentrated reagent): 5% by volume

Ethylene glycol: 40% by volume

The lignosulfonic acid solution which we have used in the practice of our invention is the effluent from a repetitive, five-step process of purification which alternates cationic and anionic ion-exchange media acting upon an input feed of aqueous ammonium lignosulfonate solution.

Using the above-recited vehicle with the customary alkaline earth carbonates and other compounds, we have successfully produced cathode coating suspensions with loadings up to about 3.5 g/ml while retaining a usable degree of fluidity. As would be expectable, much milling is required in order to reach this high level of loading, but by the practice of our invention such milling becomes practicable without serious hindrance from thixotropy or excessively paste-like consistency. As is well-known to those skilled in the art, the process of milling with concurrent additions of cathode powder is carried out in a stepwise manner.

A comparison was made between a coating suspension in accordance with this invention and a prior art coating suspension of the organic solvent type. The alkaline earth compounds used in both suspensions were barium carbonate, calcium carbonate and strontium carbonate. Both suspensions were coated on electrodes for 40 watt rpaid start fluorescent lamps, which were coiled coils of tungsten wire having a finished coil length of 16 mm. The coating weight for suspensions in accordance with this invention ranged from 11 to 13 milligrams per electrode, as against 7 to 8 milligrams per electrode for the prior art coating suspension.

We claim:

1. The method of coating an arc discharge lamp electrode comprising the step of preparing a highly loaded suspension of alkaline earth carbonates in a liquid vehicle consisting essentially of a water solution of multipurified lignosulfonic acid, ammonia and a liquid hydroxy compound to a loading greater than about 1.75 grams of carbonates per milliliter of liquid vehicle, and applying said suspension to said electrode to deposit thereon a higher-than-normal coating weight.

2. The method of claim 1 wherein said liquid hydroxy compound is ethylene glycol.

* * * * *